US005463833A

United States Patent [19]

Banez

[11] Patent Number: 5,463,833

[45] Date of Patent: Nov. 7, 1995

[54] PORTABLE FOLDING STRUCTURE

[76] Inventor: Augusto E. Banez, 1103 Del Rey Ave., Pasadena, Calif. 91107

[21] Appl. No.: 222,116

[22] Filed: Apr. 1, 1994

[51] Int. Cl.[6] ..... E04B 1/344

[52] U.S. Cl. ..... 52/71; 52/69; 52/79.5; 52/79.7

[58] Field of Search ..... 52/79.5, 79.7, 52/79.9, 79.12, 79.13, 79.1, 69, 71, 64, 79.8; 135/97, 95; 296/21, 156, 159, 164, 165, 168, 169, 171, 173, 174, 26, 27

[56] References Cited

U.S. PATENT DOCUMENTS

| | | | |
|---|---|---|---|
| 2,395,691 | 2/1946 | Smith | 52/69 |
| 2,886,856 | 5/1959 | Suk Kun Che | 52/69 |
| 3,623,296 | 11/1971 | Santoro | 52/79.12 |
| 3,692,350 | 9/1972 | Radtke | 296/26 X |
| 4,171,596 | 10/1979 | Varlonga | 52/79.5 |
| 4,741,133 | 5/1988 | Kutzner | 52/79.5 |
| 4,742,653 | 5/1988 | Napier et al. | 52/69 X |
| 4,891,919 | 1/1990 | Palibroda | 52/79.5 |
| 5,106,142 | 4/1992 | Hegedus | 52/79.5 X |

*Primary Examiner*—Carl D. Friedman
*Assistant Examiner*—Kien T. Nguyen
*Attorney, Agent, or Firm*—Macro-Search Corp.; Gene Scott

[57] ABSTRACT

A structure is provided for a portable, foldable shelter that may be folded into a compact form for transporting, and unfolded for use on a base. A set of four hinged, interconnected wall box frames, each frame having floor, wall, and roof sections hingably interconnected to it, may be folded into compact mutual, near coplanar juxtaposition. The floor, wall, and roof sections fold out from each of the four frames to form a separate room. When the structure is completely unfolded, the four rooms are arranged in cruciform layout, each having a box shape, and the rooms are positioned in corner adjacency around a box shaped open area defined by the frames. A top portion may be included for enclosing the open area, as well as auxiliary sidewalls and window sections. Further, a separate environmental control unit and a separate lavatory and toilet facility may be attached to the structure. A carport module with a cover may also be included.

16 Claims, 6 Drawing Sheets

PORTABLE FOLDING STRUCTURE

FIELD OF THE INVENTION

This invention relates generally to portable shelters and, more particularly, is directed towards a portable, foldable, quickly-assembled structure with auxiliary modules.

BACKGROUND OF THE INVENTION

A considerable expense in the construction industry is the labor expense of erecting a building structure at a building site. The faster such construction takes place, the lower will be the overall cost of the project. Weather delays, and the like, frequently wreck enormous cost overruns to constructions projects. Consequently, there has been a demand in recent years for pre-assembled and easily-assembled building structures. Moreover, there has been a demand for low-cost, easily transported structures.

To help meet this demand, building "kits"are available for building relatively simple homes and other structures from pre-fabricated wall sections and step-by-step assembly instructions. Building kits are still relatively complicated to assemble, expensive, and take a considerable time to build. Pre-built rooms, complete with roof, are available to be trucked to the site and joined with other building sections to form a complete residence or other structure. Such pre-built rooms are difficult to transport and are also relatively expensive. Precast concrete panels are also available, and are typically transported by rail or truck to the site and tilted-up and fastened into place. Such concrete panels are extremely heavy and difficult to work with, are limited to monotonous forms, and are also expensive. Even inflatable and tent-like structures are available, but while extremely fast to erect they provide less effective shelter and are not generally considered permanent. All of these types of building elements and methods have considerable drawbacks associated with their use.

Clearly, then, there still remains a need for an easily transported and assembled building structure that can be readily assembled with a minimum amount of labor and in a relatively short period of time. Such a needed invention would be light weight, inexpensive to manufacture, and provide sturdy, permanent shelter. Such a needed invention would further be configurable in a variety ways to meet varying needs, and would provide several add-on modules for further customization and utility. The present invention fulfills these needs and provides further related advantages.

SUMMARY OF THE INVENTION

The present invention uses a unique principle of side-hinged frames each themselves holding hinged surfaces that fold out to provide floors, walls, and the like. The present invention is a structure for a portable, foldable shelter that may be folded into a compact form for transporting, and unfolded for use on a base. A set of four hinged, interconnected wall box frames, each frame having floor, wall, and roof sections hingably interconnected to it, may be folded into mutual, near coplanar juxtaposition for transport. The floor, wall, and roof sections fold out from each of the four frames to form a separate room. When the structure is completely unfolded, the four rooms are arranged in cruciform layout, each having a box shape. The rooms are positioned in corner adjacency around a box shaped open area defined by the frames. A top portion may be included, for enclosing the open area, as well as auxiliary sidewalls and window sections for enclosing the sides of the separate rooms. Further, a separate environmental control unit and a separate lavatory and toilet facility may be attached to the structure. A carport module with a cover may also be included.

The present invention is an easily transported and assembled building structure that can be readily assembled with a minimum amount of labor and in a relatively short period of time. The present invention is relatively lightweight, inexpensive to manufacture, and provides sturdy, permanent shelter. The device may be configured in a variety ways to meet varying needs, and provides several add-on modules for further customization. Other features and advantages of the present invention will become apparent from the following more detailed description, taken in conjunction with the accompanying drawings, which illustrate, by way of example, the principles of the invention.

BRIEF DESCRIPTION OF DRAWINGS

The accompanying drawings illustrate the invention. In such drawings.

DETAILED DESCRIPTION OF THE PREFERRED EMBODIMENT

Figure 1:
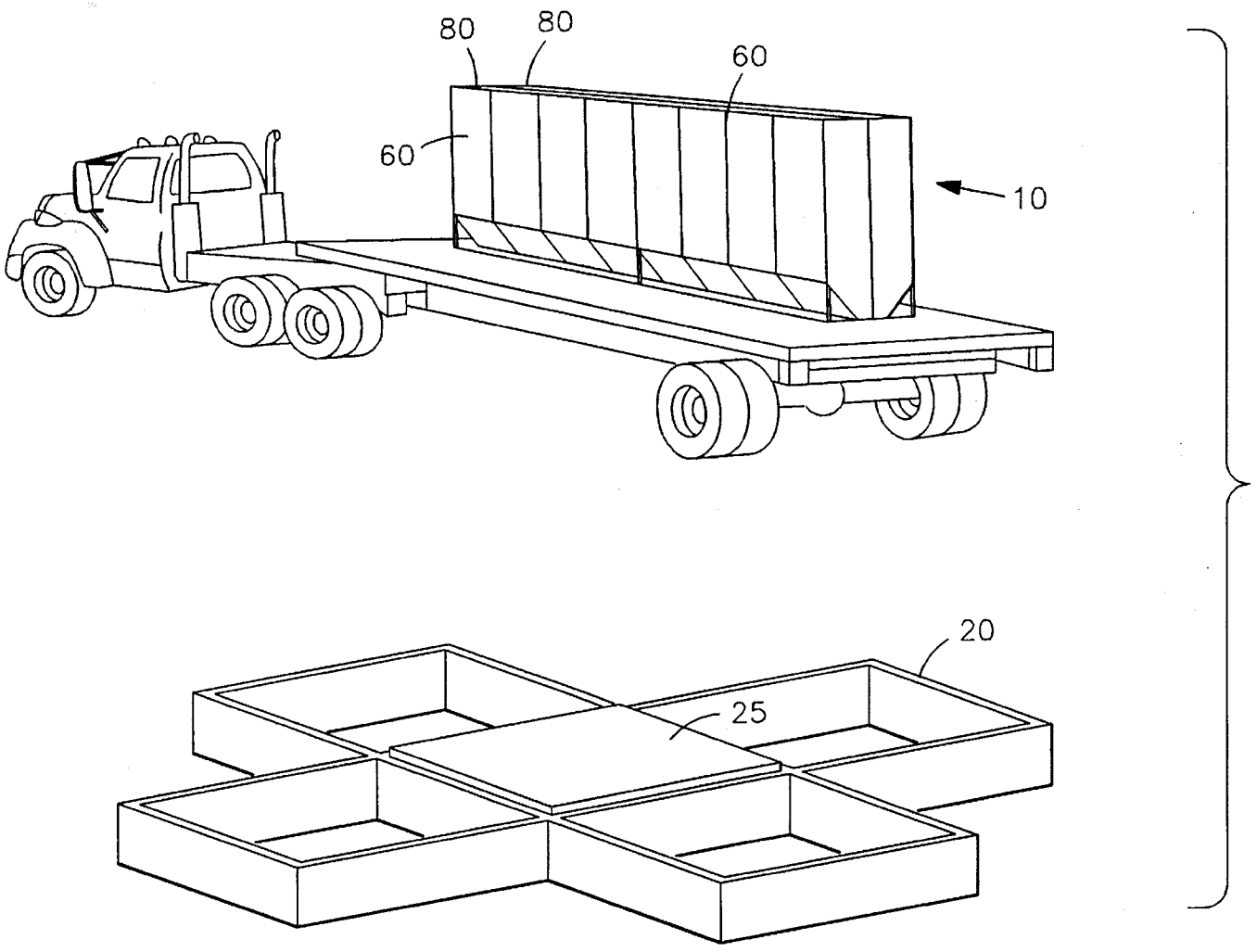
FIG. 1 is a perspective view of the portable folding structure of the invention in transit, illustrating a base onto which a set of four hingably interconnected wall box frames are erected.
Figure 2:
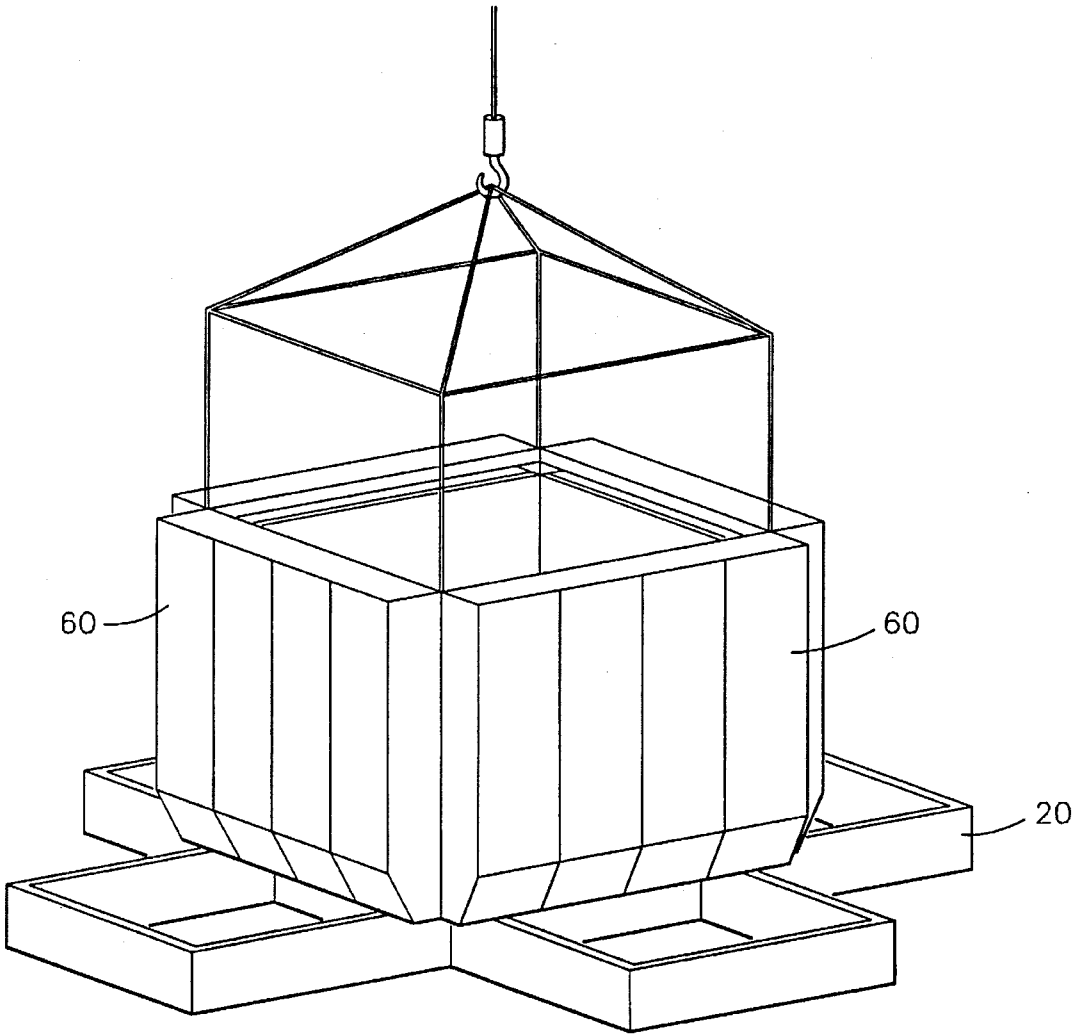
FIG. 2 is a perspective view of the invention, illustrating the set of four hingably interconnected wall box frames unfolded and positioned on the base of FIG. 1.
Figure 3:
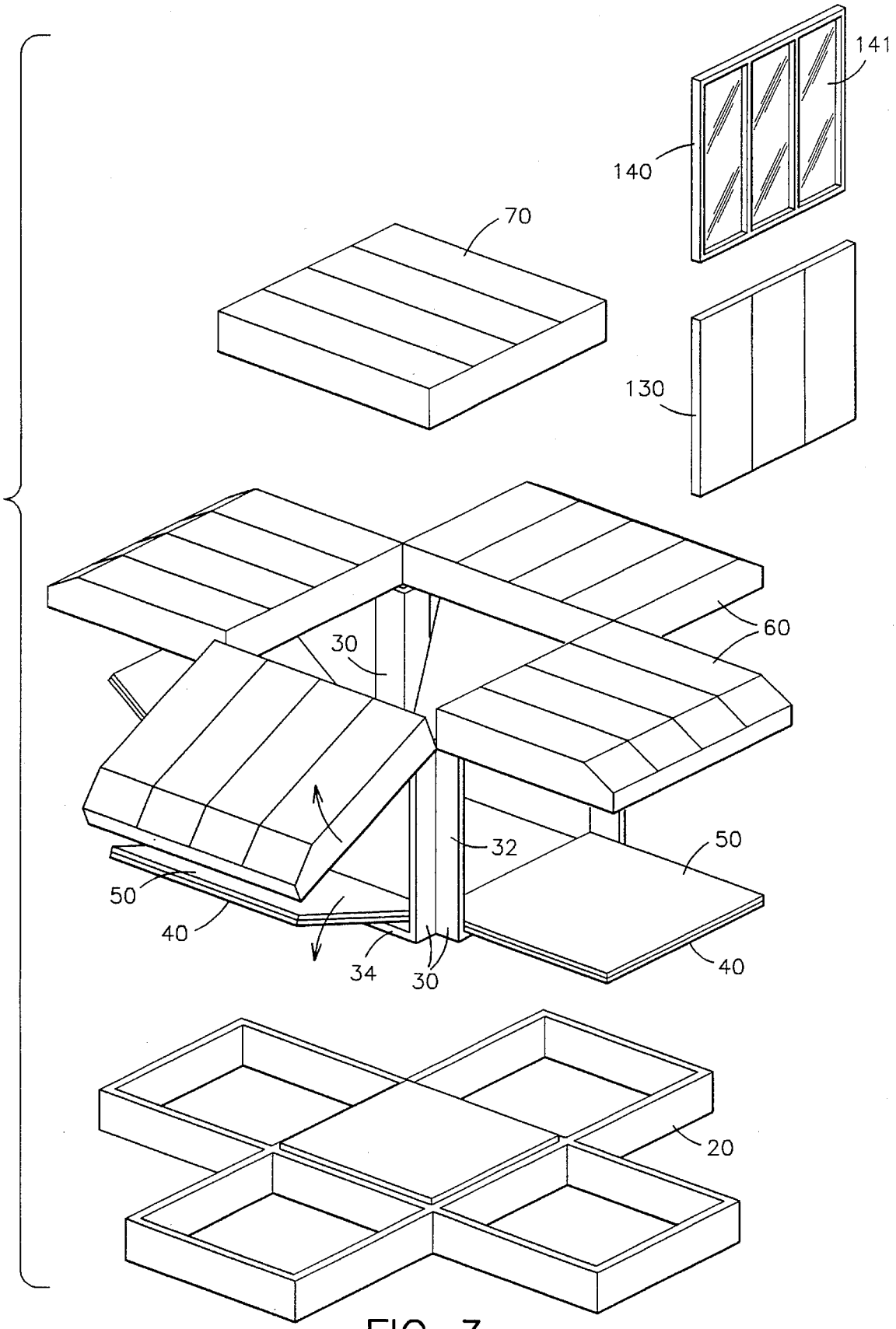
FIG. 3 is an exploded view of the invention, illustrating a plurality of floor, wall, and roof sections unfolding from each wall box frame, and further illustrating auxiliary sidewalls and window sections.
Figure 4:
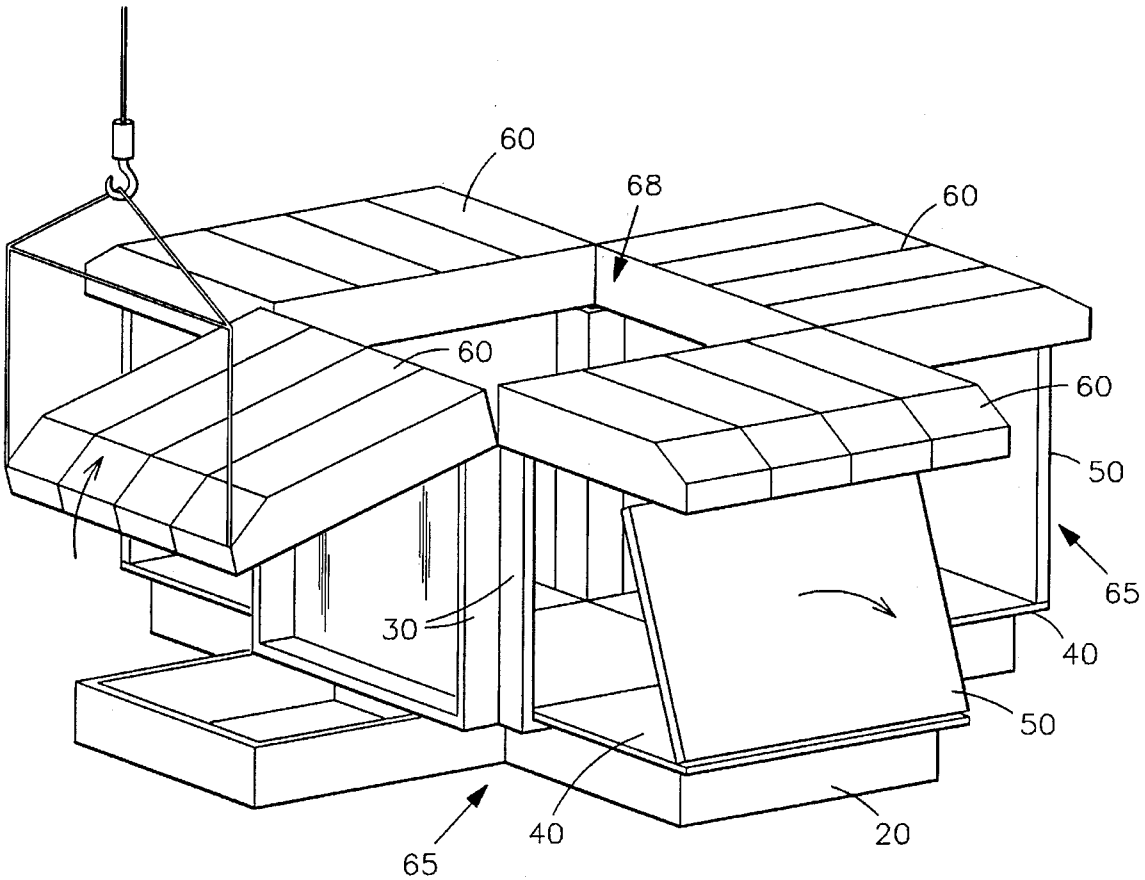
FIG. 4 is a perspective view of the invention, illustrating a roof section of one wall box frame as being rotated into position during assembly, and further illustrating a separate utility module and a separate facility module that may be bolted onto structure.
Figure 4:
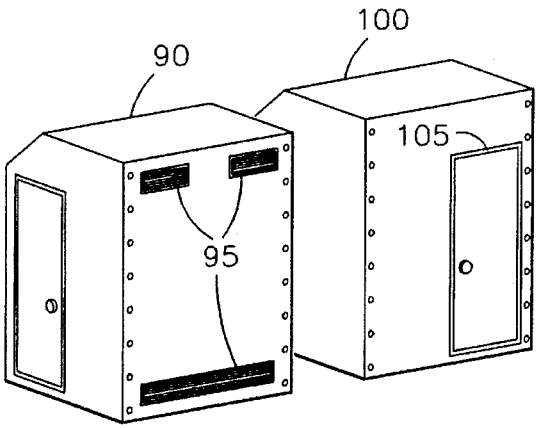

FIG. 1 shows a structure capable of folding into a compact form 10 for transporting and unfolding for use on a base 20. The base 20 is preferably made from a strong material, such as wood planks, cement blocks, or the like. The base 20 further includes a central floor area 25. The structure, as best seen in FIG. 3, comprises a set of four hingably interconnected wall box frames 30 each having opposing pairs of vertical structural members 32 and horizontal structural members 34. The frames 30 are made from any suitably strong and rigid wood, steel, or plastic material. The frames 30 are hingably interconnected at the vertical members 32 for cooperating in folding into mutual, near coplanar juxtaposition. The four frame structures 30 are hinged so as to be folded as two pairs of two frame structures 80 each, each of the pairs 80 being arranged colinearly and mutually adjacent, as shown in FIG. 1, for facilitating transportation thereof. The frames 30 include hinges (not shown) that may be any of several suitable types, such as conventional door hinges, elongated piano hinges, or pivotally interlocking members of the frames 30. A plurality of floor sections 40, wall sections 50, and roof section 60 are hingably interconnected with the frames 30 for folding into near coplanar juxtaposition with each of the box frames 30 in the compact form 10, and for unfolding from the box frames 30 to form separate rooms 65 (FIGS. 3 and 4). In the compact form 10, the roof sections 60 enclose the frames 30, and the folded floor sections 40 and wall sections 50. After assembly, a top portion 70 may be further included for covering a box-shaped open area 68 in order to enclose the open area 68 (FIG. 3). The floor sections 40, wall sections 50, roof sections 60, and top portion 70 are each made from a suitably strong, rigid material, such as plywood, sheet aluminum, plastic sheet material, or a combination thereof. Each section 40,50,60 and top portion 70 may further include suitable thermal insulating and sound absorbing materials. Each of the sections 40,50,60 include suitable hinge means (not shown), as above, for allowing relative pivotal movement thereof with the frame 30.

As such, the structure, when unfolded, comprises four rooms 65 in cruciform layout. Each of the rooms 65 is generally box shaped, and the rooms 65 are positioned in corner adjacency around the box shaped open area 68 defined by the frames 30. Auxiliary sidewalls 130 and window sections 140 are included for mounting in the structure for fully enclosing the separate rooms 65. The window sections 140 include a plurality of transparent windows 141. At least one of the sidewalls 130 includes a door section 135 for providing access to the separate rooms 65 and the open area 68 from outside of the structure.

Figure 5:
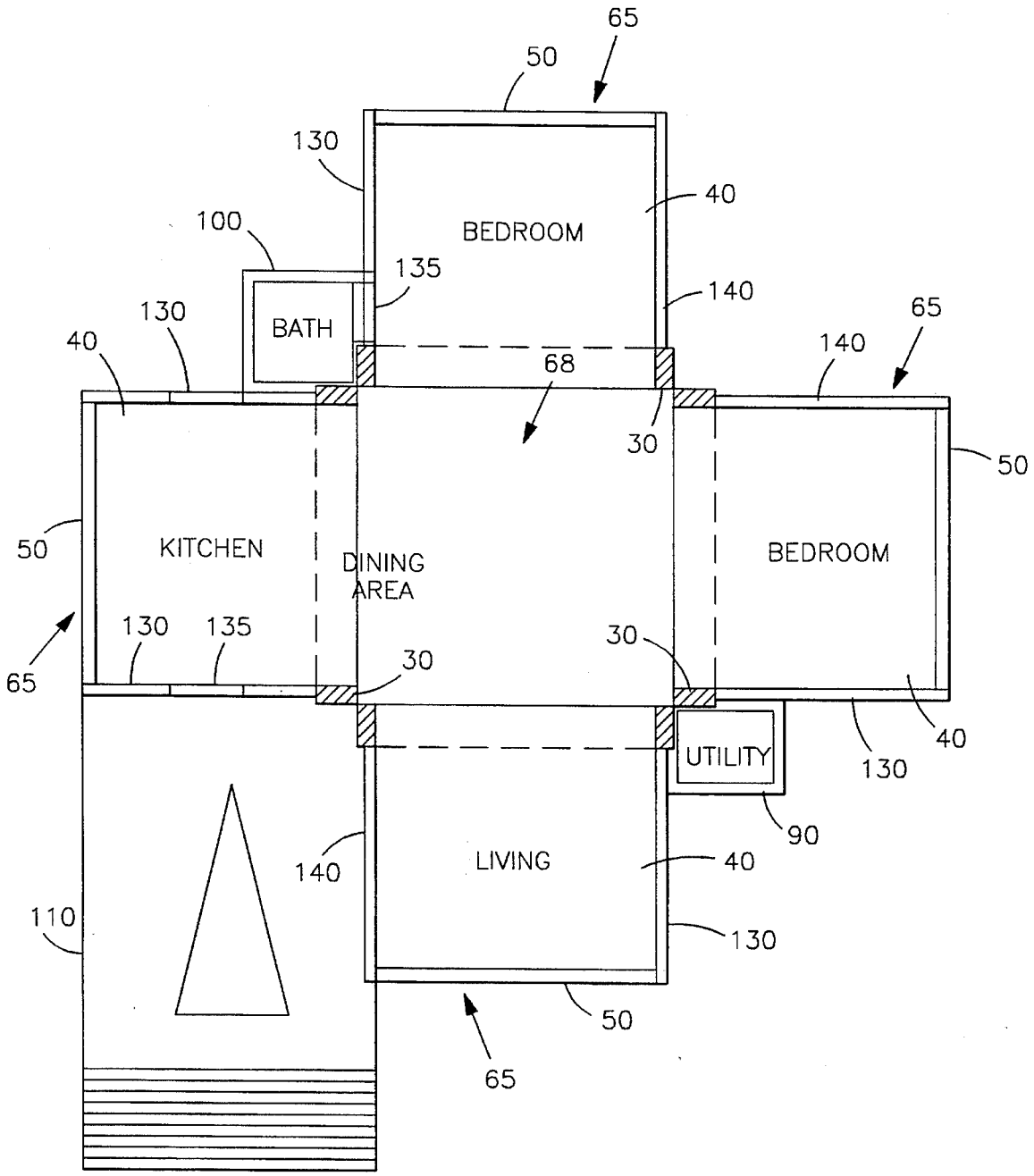
FIG. 5 is a top plan view of the interior of the invention as completely assembled, illustrating an auxiliary carport module.
Figure 6:
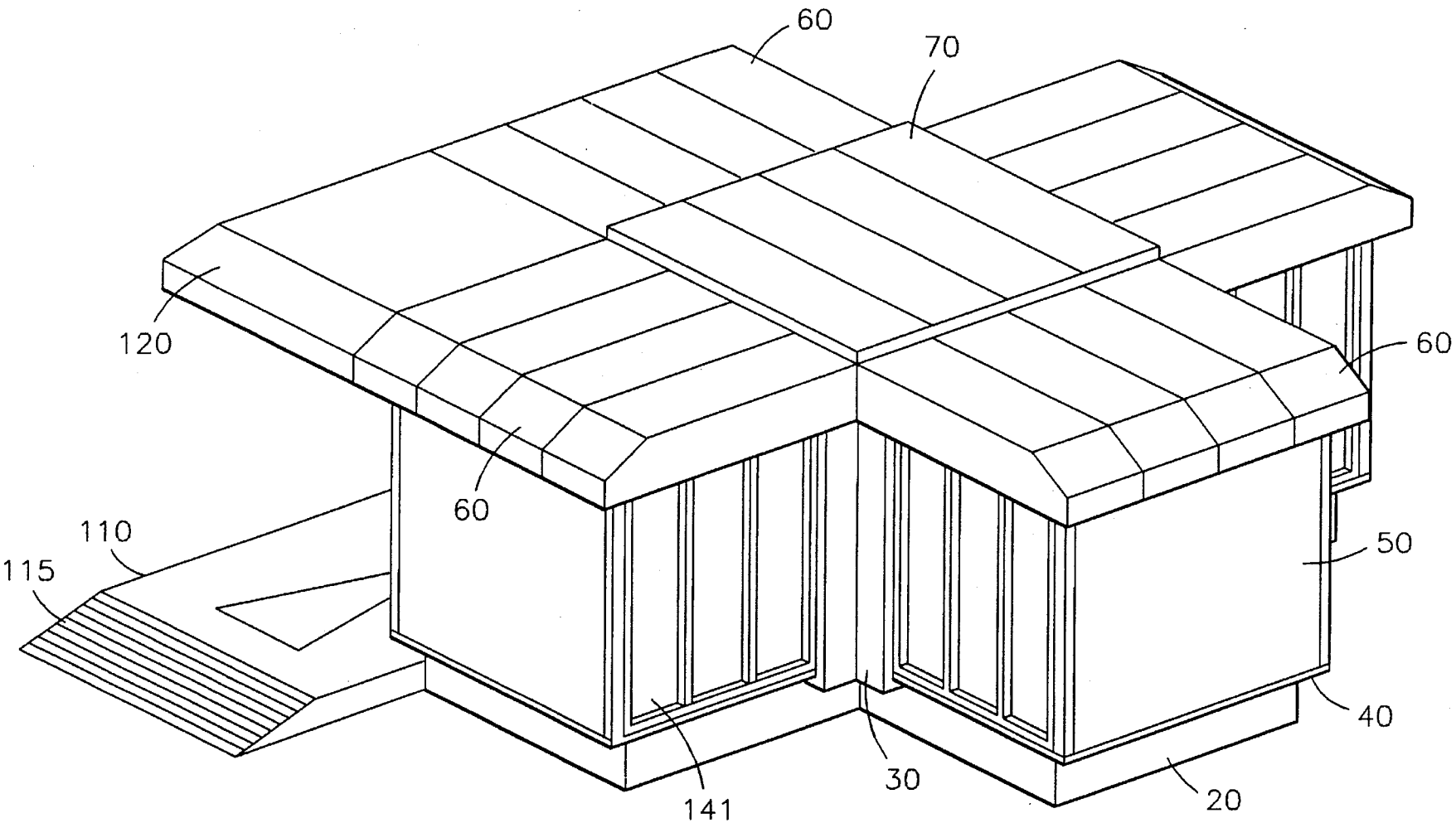
FIG. 6 is a perspective illustration of the invention as completely assembled, illustrating the placement of the auxiliary window sections and a carport cover.

A utility module 90 is adapted for attachment to the structure for providing interior environment monitoring and control. The utility module 90 may be bolted into one of the wall sections 50 or sidewalls 130 (FIGS. 4 and 5). The utility module 90 preferably includes forced air heating and cooling means, as well as air ducts 95 in fluid communication with the rooms 65 and the open area 68 of the structure.

A facility module 100 is adapted for attachment to the structure for providing a lavatory and toilet facility to the structure. The facility module 100 may be bolted into one of the wall sections 50 or sidewalls 130 (FIGS. 4 and 5), and includes a passageway 105 for allowing a person to gain access thereto from at least one of the separate rooms 65.

A carport module 110 includes a carport cover 120 and is adapted for attachment to the structure for providing parking facilities to the structure. The carport module 110 preferably includes a ramp section 115, and is bolted into the base 20 proximate to one of the door sections 135.

While the invention has been described with reference to a preferred embodiment, it is to be clearly understood by those skilled in the art that the invention is not limited thereto. For example, other add-on modules might be devices, such as a kitchen module complete with standard kitchen appliances, a laundry module complete with laundry appliances, and the like. Thus, the scope of the invention is to be interpreted only in conjunction with the appended claims.

What is claimed is:

1. A structure capable of folding into a compact form for transporting, and for simple unfolding for use on a base, the structure comprising:

a set of four hingably interconnected wall box frames each having opposing pairs of vertical and horizontal structural members, the frames hingably interconnected at the vertical members for cooperating in folding into mutual, near coplanar juxtaposition;

a plurality of floor, wall and roof sections hingably interconnected with the frames for folding into near coplanar juxtaposition with each of the box frames and for unfolding from the box frames to form separate rooms;

whereby the structure, when unfolded comprises four rooms in cruciform layout, each of the rooms box shaped, the rooms positioned in corner adjacency around a box shaped open area defined by the frames.

2. The structure of claim 1 further including a top portion for covering the open area to enclose same.

3. The structure of claim 1 wherein the roof sections enclose the frames, and floor and wall sections when same are in the compact form.

4. The structure of claim 1 wherein the four frame structures are hinged so as to be folded as two pairs of two frame structures each, each of the pairs of the frame structures being arranged colinearly, the two pairs being arranged mutually adjacent.

5. The structure of claim 1 further including a utility module adapted for attachment to the structure for providing interior environment monitoring and control.

6. The structure of claim 1 further including a facility module adapted for attachment to the structure for providing a lavatory and toilet facility to the structure.

7. The structure of claim 1 further including a carport module including a carport cover adapted for attachment to the structure for providing parking facilities to the structure.

8. The structure of claim 1 further including auxiliary sidewalls and windows adapted for mounting in the structure for fully enclosing the separate rooms.

9. A structure capable of folding into a compact form for transporting, and for simple unfolding for use on a base, the structure comprising:

a set of four hingably interconnected wall box frames each having opposing pairs of vertical and horizontal structural members, the frames hingably interconnected at the vertical members for cooperating in folding into mutual, near coplanar juxtaposition;

each of the frames including a floor section hingably attached for folding into coplanar arrangement with the frame and for folding out of the frame into horizontal orientation, and a wall section hingably interconnected with the floor section for folding into adjacent coplanar orientation with the floor section, and for folding into a vertical position in parallel arrangement with the frame, and a roof section hingably attached to the frame for folding into near coplanar juxtaposition with the frame and for unfolding from the frame into a horizontal orientation above the unfolded floor section, such that with floor, wall and roof sections in the unfolded orientation, the box frames forming separate rooms;

whereby the structure, when unfolded comprises four rooms in cruciform layout, each of the rooms being box shaped, the rooms positioned in corner adjacency around a box shaped open area defined by the frames.

10. The structure of claim 9 further including a top portion for covering the open area to enclose same.

11. The structure of claim 9 wherein the roof sections enclose the frames, and floor and wall sections when same are in the compact form.

12. The structure of claim 9 wherein the four frame structures are hinged so as to be folded as two pairs of two frame structures each, each of the pairs of the frame structures being arranged colinerly, the two pairs being arranged mutually adjacent.

13. The structure of claim 9 further including a utility module adapted for attachment to the structure for providing interior environment monitoring and control.

14. The structure of claim 9 further including a facility module adapted for attachment to the structure for providing a lavatory and toilet facility to the structure.

15. The structure of claim 9 further including a carport module including a carport cover adapted for attachment to the structure for providing parking facilities to the structure.

16. The structure of claim 9 further including auxiliary sidewalls and windows adapted for mounting in the structure for fully enclosing the separate rooms.

* * * * *